US005146436A

United States Patent [19]

Wright

[11] Patent Number: 5,146,436

[45] Date of Patent: Sep. 8, 1992

[54] UNIVERSAL WORLD CLOCK

[76] Inventor: James B. Wright, 400 Hiram Page Rd., #102, Yreka, Calif. 96097

[21] Appl. No.: 743,082

[22] Filed: Aug. 9, 1991

[51] Int. Cl.[5] ..... G04B 19/22

[52] U.S. Cl. ..... 368/21; 368/27

[58] Field of Search ..... 368/21-24, 368/27

[56] References Cited

U.S. PATENT DOCUMENTS

| | | | |
|---|---|---|---|
| 536,504 | 3/1895 | Arriaga . | |
| 693,814 | 2/1902 | Davis . | |
| 1,832,342 | 11/1931 | Willis . | |
| 2,056,089 | 9/1936 | Boggs | 368/27 |
| 2,078,345 | 4/1937 | Robertson | 368/27 |
| 2,496,826 | 2/1950 | Tellier | 58/43 |
| 2,910,825 | 11/1959 | Kirkwood | 58/43 |
| 3,091,915 | 6/1963 | Pawl | 58/44 |
| 3,763,645 | 10/1973 | Kim | 58/43 |
| 4,502,789 | 3/1985 | Heath | 368/27 |
| 5,054,008 | 10/1991 | Darling | 368/27 |

*Primary Examiner*—Vit W. Miska

*Attorney, Agent, or Firm*—John P. O'Banion

[57] ABSTRACT

A universal world clock (10) for indicating universal standard and fast time at any geographical location in the world. A south polar projected world map superimposed onto a manually rotatable map disk (14) is divided with twenty-four time zone indicator lines (20) representing the time zones of universal time, the map disk (14) being positioned such that the user's geographic location is vertically oriented to represent map north, and the map disk (14) being further positioned so that the time zone indicator lines (20) are aligned with time zone pointers (22) located on a separate zone pointer disk (16) which is fixed in position over the map disk (14). A time disk (18) having hour indicators differentiated by a.m. and p.m., and having a shaded portion (32) representing night is positioned over the zone pointer disk (16) and stepped counterclockwise each hour in increments of fifteen degrees of rotation thereby positioning the hour indicators (30) over the time zone pointers (22), each step representing one time zone. The clock also includes indicators for displaying minutes and seconds.

20 Claims, 4 Drawing Sheets

UNIVERSAL WORLD CLOCK

BACKGROUND OF THE INVENTION

1. Field of the Invention

This invention pertains generally to clocks, and more particularly to a universal world clock which depicts accurate universal standard and adjusted time for every time zone throughout the world using a geographically correct map.

2. Description of the Background Art

World clocks heretofore developed have attempted to depict geographically complex time zones to provide accurate readings of time throughout the world. While many of these devices correlate time of day and day/-night characteristics by using world maps, some devices present only a crude approximation of either adopted time or universal standard time. Others attempt to depict correct standard or adopted time, but do so by repositioning the true geographical location of a place on the map to an adopted time zone. Still, others rotate the map so that the user never has a fixed point of reference for his own time zone. This distorts the normal concept of time and space, and renders these devices inaccurate.

For example, U.S. Pat. No. 1,832,342 issued to Willis on Nov. 17, 1931, discloses a chronological device which has a time dial marked with the 24 hours of day or night, made to revolve by hand or mechanically around the dial of a clock. The time dial is shaded with light and dark sections to denote the hours of day and night, and is such that, for example, when it is noon at any place, if noon on the dial is turned to that place, the exact standard or adopted time at that moment shall be indicated by the dial in all places in the world. Extending outward from the center of the dial are radiating lines of meridian, not showing geographical positions, but standard or adopted time. Superimposed upon the apparatus is a fixed position south-pole polar projection map of sorts, which groups the location of places throughout the world according to their corresponding time meridian, generally according to continents. The device disclosed therein, however, does not show the proper position of the places on the map, therefore rendering the device inaccurate. Nor can the device disclosed therein indicate changes in local time. Additionally, the user must "hunt" on the map to find his particular location and time zone.

U.S. Pat. No. 4,502,789 issued to Heath on Mar. 5, 1985, discloses a clock for estimating the time for effectively all countries and time zones of the world, the hour hand of the clock being in the form of a disk that rotates once every 24 hours against a 24 hour scale. Projected on the disk is a map of the world centered on the South Pole with the majority of the time zones positioned in accurate longitude but adjusted latitude around the periphery of the disk. The clock also includes indicators for each time zone to provide visual indication of the time, and a minutes and second hand for more exact time readings. However, the device disclosed therein does not accurately display the latitude of the countries depicted, provide coordinates of the geographical locations, or provide full map-time zone indicators necessary for accurate portrayal of time and location. And, because the map rotates, the user is inconvenienced from having to relocate his time zone to determine the correct time at any moment.

Other devices show generally the time in any time zone in the world as well as locally by placing map segments on the hands of the dial or by having the hands of the dial point to particular names of locations. For example, U.S. Pat. No. 3,091,915 issued to Pawl on Jun. 4, 1963, discloses various forms of a universal timepiece which will tell, at a glance, the time in any other time zone in the world as well as locally, by generally placing map segments on the hands of the dial. U.S. Pat. No. 2,496,826 issued to Tellier on Feb. 7, 1950, discloses a world clock in which the hands point to names of geographical locations placed through the dial. U.S. Pat. No. 3,763,645 issued to Kim on Oct. 9, 1973, discloses an hour dial shaped into twelve equal sectors with stickers provided with the names of cities in other time zones of the world placed in the sectors. U.S. Pat. No. 693,814 issued to Davis on Feb. 18, 1902, discloses a geographical clock with a hand which points to the names of selected cities positioned around the dial. U.S. Pat. No. 2,910,825 issued to Kirkwood on Nov. 3, 1959, discloses a geographical timepiece of the type where selected cities are positioned around the dial for determination of the time in that city. U.S. Pat. No. 536,504 issued to Arriaga on Mar. 26, 1895, discloses a clock with moveable map portions to show time changes throughout the world.

None of the devices or solutions to timekeeping disclosed in the foregoing patents, however, provide for accurate geographical maps superimposed upon the clock mechanism, retain correct placement of countries relative to the user, or place the user in a fixed position to permit time to flow past the user as in the present invention. The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

This invention pertains to a universal clock in which a world map projected from the south pole is positioned relative to the user such that the user's geographical location on the map is oriented vertically, and the correct time in the user's time zone is displayed in a constant position on the map as is the time anywhere in the world.

The world map, which has geographically correct positioning of the countries and lines of longitude and latitude, is divided into twenty-four time zones with time zone indicators emanating radially from the central portion of the map in increments of fifteen degrees. The map is superimposed onto a first disk, or map disk, which is manually rotatable by the user.

Positioned over the map disk is a time zone indicator sheet which is fixed in position. Superimposed on the time zone indicator sheet is a dials disk which has time zone pointers positioned around its periphery in increments of fifteen degrees. Positioned vertically, at the top of the dials disk, are two larger alignment pointers, one of which represents standard time based on universal coordinated time, and the other of which represents adjusted time such as daylight savings time. To position the map, the user rotates the map disk until his or her geographical location is positioned between the two alignment pointers and those pointers are aligned with the time zone indicators on the map disk. The user is then able to view his or her geographical location and time zone in an upright position at the top center of the clock with north at the very top of the world map.

A third disk, or time disk, is placed over the time zone indicator sheet and attached to a timing mechanism which causes one counterclockwise revolution of the time disk every twenty four hours. Located around the periphery of the time disk are hour markings, each marking spaced in increments of fifteen degrees. The hour markings are further differentiated by a.m. and p.m., and one-half of the time disk is shaded to represent night. The time disk rotates in a counterclockwise direction so that time flows past the user's map position. The clock also includes indicators for the user to determine the number of minutes into the hour and the number of seconds into the minute for each geographic location.

To preserve proper concept of time, the time disk does not rotate continuously past the user's position. Instead, the time disk is stepped each hour with rotation occurring in steps of fifteen degrees, each step leaving the hour markings in alignment with the time zone pointers. Therefore, the user can look at any of the time zone pointers and instantly determine the correct time anywhere in the world, the geographic locations remaining fixed for easy reference. Additionally, since the shaded portion of the time disk rotates with the time disk, the user can also quickly determine whether it is night or day in any geographic location.

An object of the invention is to provide for accurate easily read local time anywhere in the world.

Another object of the invention is to provide for accurate at-a-glance universal time anywhere in the world.

Another object of the invention is to enable simple calculation of time differentials between geographic locations falling in different time zones.

Another object of the invention is to provide a world clock which simulates the relativity of time flow.

Another object of the invention is to provide a geographically accurate presentation of locations in the world relative to the time at each, with correct longitudinal and latitudinal positioning.

Another object of the invention is to provide a world clock where any user's geographical position on the clock can be vertically oriented to the top center of the clock map, thus positioning north overhead.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes the present invention is embodied in the apparatus generally shown in FIGS. 1 through 6. It will be appreciated that the apparatus may vary as to configuration and as to details of the parts without departing from the basic concepts as disclosed herein.

Figure 1:
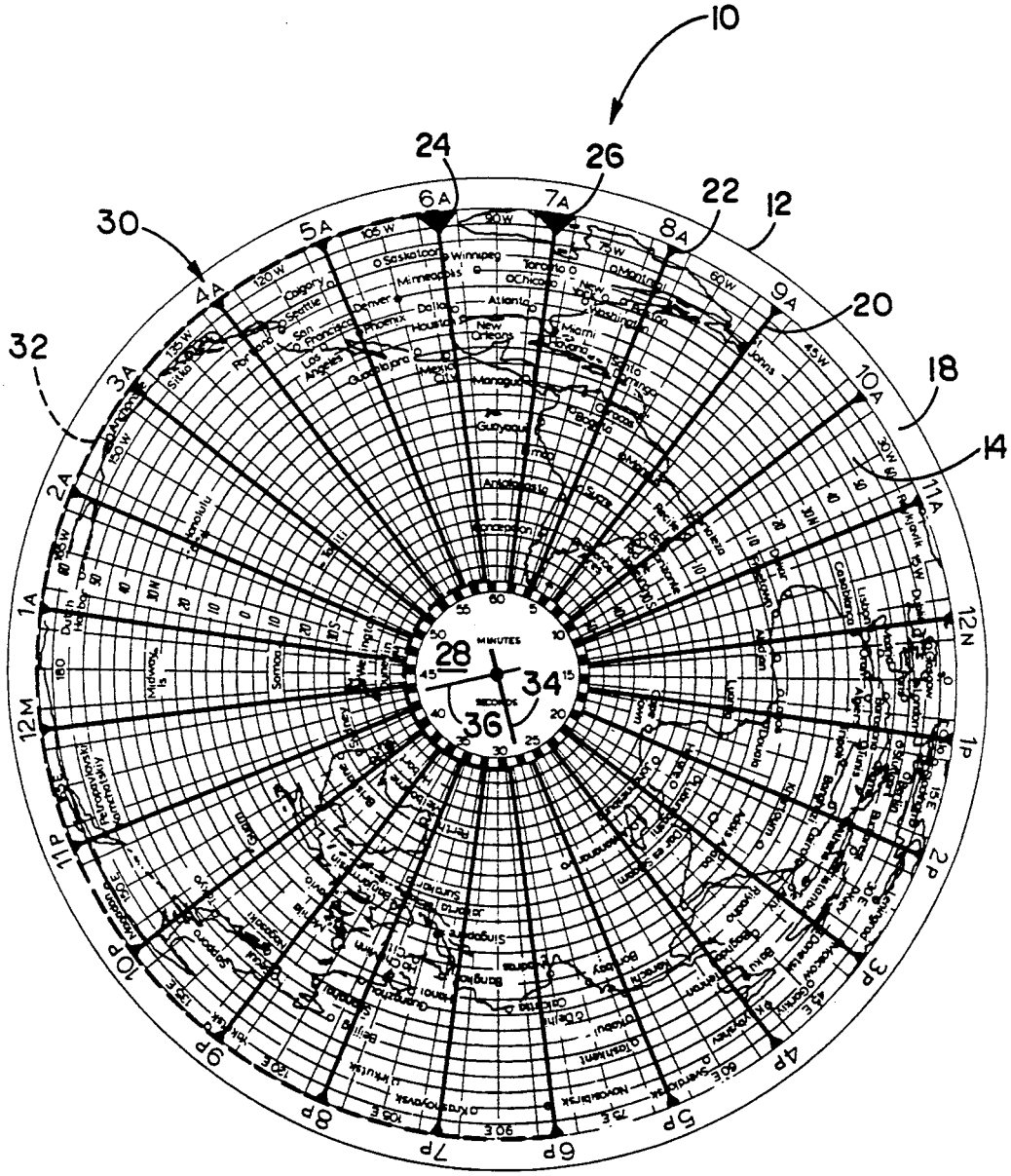
FIG. 1 is a plan view of the face of the clock in accordance with the present invention.
Figure 2:
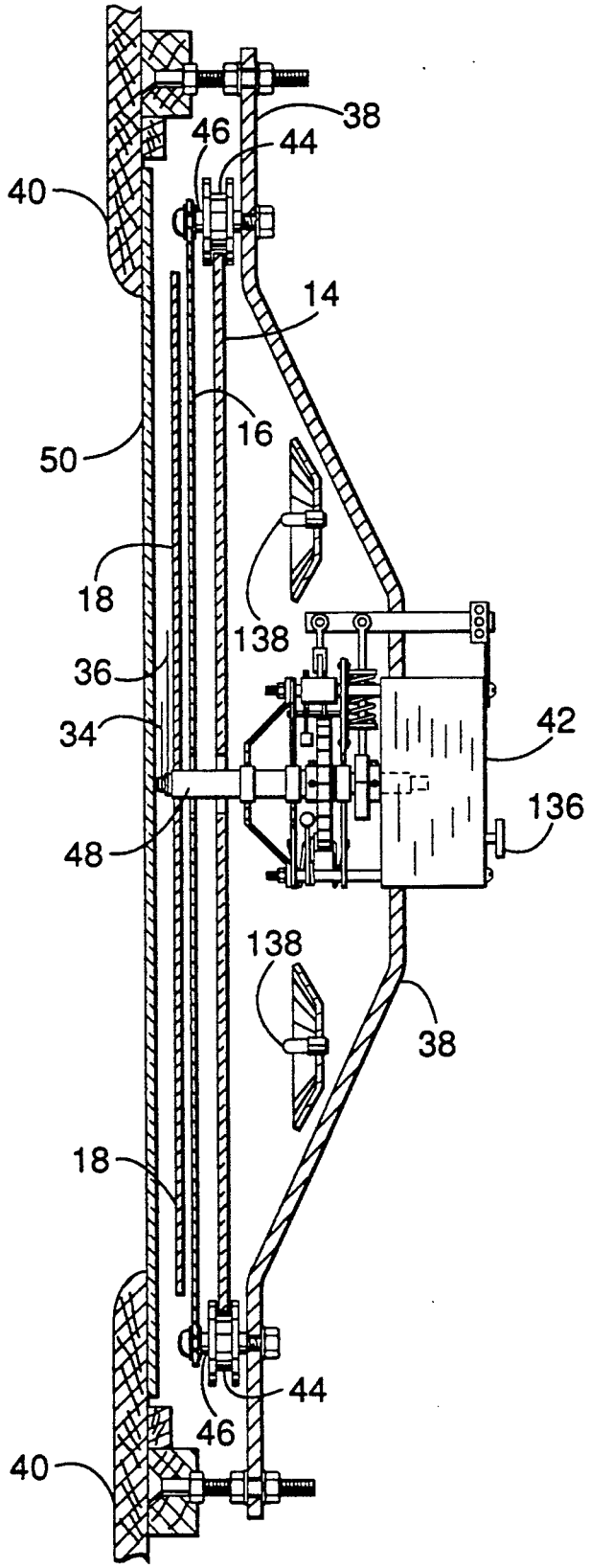
FIG. 2 is a cross-sectional view of the clock illustrated in FIG. 1.

Referring to FIG. 1 and FIG. 2, clock 10 includes a circular clock face 12 having a map disk 14, a dials sheet 16, and an hours disk 18. Map disk 14 is a substantially translucent glass or plastic disk having a projection of the world covering substantially all of its surface area. The projection of the world is centered at the south pole with the countries of the world being geographically presented with accurate longitude and latitude, and includes that portion of the earth lying roughly between Iceland and the tip of South America (from 65 degrees north latitude to 55 degrees south latitude). The oceans, land masses, and major cities are plotted so that the user can locate his or her geographical location Political boundaries could also be plotted if desired.

The central portion of the projection which would represent Antarctica is left blank so as to permit dials sheet 16 to be overlaid in front of that portion of map disk 14. Map disk 14 is divided into twenty-four time zones with time zone indicators 20 emanating radially from its central portion in increments of fifteen degrees. Time zone indicators 20 are located on map disk 14 as geographically correct time zones to represent universal time rather than as time zones which represent politically established time. Map disk 14 can be rotated to any desired position.

Dials sheet 16, which is fixed in position, is a substantially transparent glass or plastic sheet on which a dials disk having substantially the same diameter as map disk 14 is superimposed. Dials sheet 16 is relationally positioned in front of map disk 14, and includes a plurality of time zone pointers 22 representing universal standard time which are positioned around the periphery of dials sheet 16 in increments of fifteen degrees, thereby forming a circular dials disk. In effect, dials sheet 16 is a square-shaped "disk" which supports the projection of the aforementioned dials disk bounded at its circumference by time zone pointers 22.

Time zone pointers 22 are positioned in alignment with time zone indicators 20. One of the time zone pointers 22, standard time pointer 24, is larger in size than time zone pointers 22. Another of the time zone pointers 22, fast time pointer 26, is also larger in size than time zone pointers 22. Standard time pointer 24 is colored black and is used to determine the correct universal standard time for the user's geographical location. Fast time pointer 26 may be colored red and is used to determine the correct local "fast time" or "daylight savings time" (one hour later) for the user's geographical location without adjusting the clock, since fast time pointer 26 is one time zone away from standard time pointer 24. Dials sheet 16 also includes a centrally positioned minutes and seconds dial 28 which is the same diameter as the blank central portion of map disk 14.

Hours disk 18 is a substantially transparent disk having approximately the same diameter as map disk 14.

Hours disk 18 is relationally positioned in front of dials sheet 16 and includes hour indicators 30 positioned around its periphery in fifteen degree increments depicting hours of day and night. Hours disk 30 also includes shaded portion 32 which covers the portion of its surface between 6 p.m., midnight, and 6 a.m. to represent nighttime hours. Hours disk 18 makes one complete revolution every twenty-four hours.

To set the apparatus for correct operation, the user rotates map disk 14 so that his or her geographical location is positioned between universal time pointer 24 and fast time pointer 26, and time zone pointers 22 are aligned over time zone indicators 20. The user reads the correct universal solar time hour above universal time pointer 24 and reads "fast time" or "daylight savings time" hour above universal time pointer 26.

In operation, hours indicators 30 rotate counterclockwise with hours disk 18, and always rest above time zone pointers 22. Instead of hours disk 18 rotating continuously, hours disk 18 steps in twenty-four increments of fifteen degrees each to preserve proper concept of time. Therefore, the user can look at any of the time zone pointers 22 and instantly determine the correct time anywhere in the world, the geographic locations remaining fixed for easy reference. Since shaded portion 32 rotates with hours disk 18, the user can also quickly determine whether it is night or day in any geographic location. Note also that shaded portion 32 rotates counterclockwise, thus representing movement of the sun from the east to the west across map disk 14 as is observed with each successive dawn and dusk. Minutes hand 34 and seconds hand 36, together with minutes and seconds dial 28, provide the user with the correct minutes and seconds past the hour.

In this manner, the user's time zone is always located in the top center position of clock face 12 for ease of use. Additionally, once the position of map disk 14 is set, time flows past the user with rotation of hours disk 18 thereby preserving normal temporal concepts.

Referring now to FIG. 2, clock 10 includes a support frame 38 which is rigidly secured to a housing 40. Secured to frame 38 is drive mechanism 42, as well as a plurality of idler wheels 44 which act as guides to hold map disk 14 in position. Idler wheels 44 firmly engage map disk 14 so as to secure map disk 14 to frame 38 while permitting map disk 14 to be rotated when desired. Dials sheet 16 is positioned forward of map disk 14 and fixedly secured to a plurality of standoff bushings 46 which are in turn secured to frame 38. Hours disk 18 is positioned forward of dials sheet 16 and is attached to hours shaft 48 of drive mechanism 42. Cover face plate 50 is positioned forward of hours disk 18 and secured to housing 40 as a protective cover.

Figure 3:
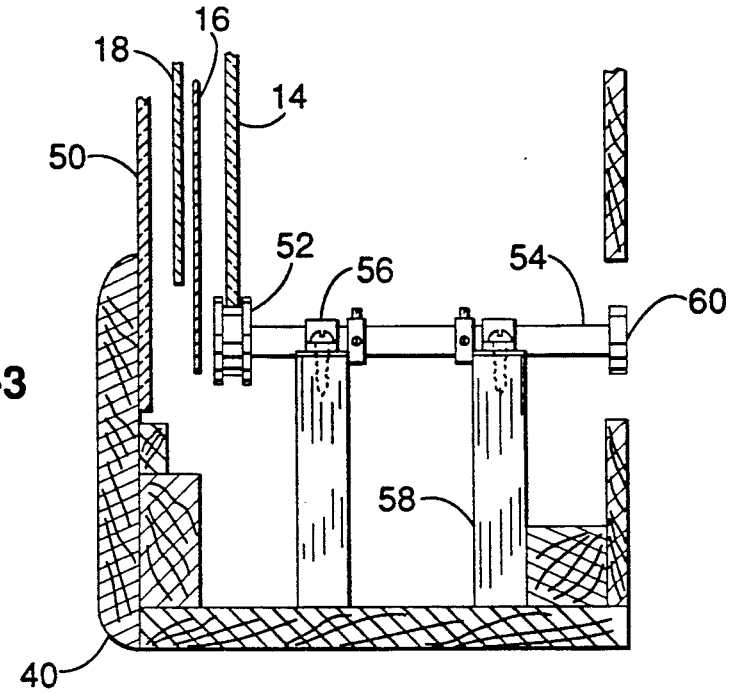
FIG. 3 is a cross-sectional view of the map adjustment mechanism portion of the clock illustrated in FIG. 2.

The mechanism for manually adjusting the position of map disk 14 can be seen in FIG. 3. Map adjust wheel 52, which is made of rubber or the like, is located at the bottom edge of map disk 14 directly below its vertical central axis and frictionally engages map disk 14. One end of shaft 54 is secured to map adjust wheel 52, shaft 54 being held in place by a plurality of clamps 56 and standoff posts 58. The other end of shaft 54 is attached to knob 60 which, when rotated, causes map disk 14 to rotate.

Figure 4:
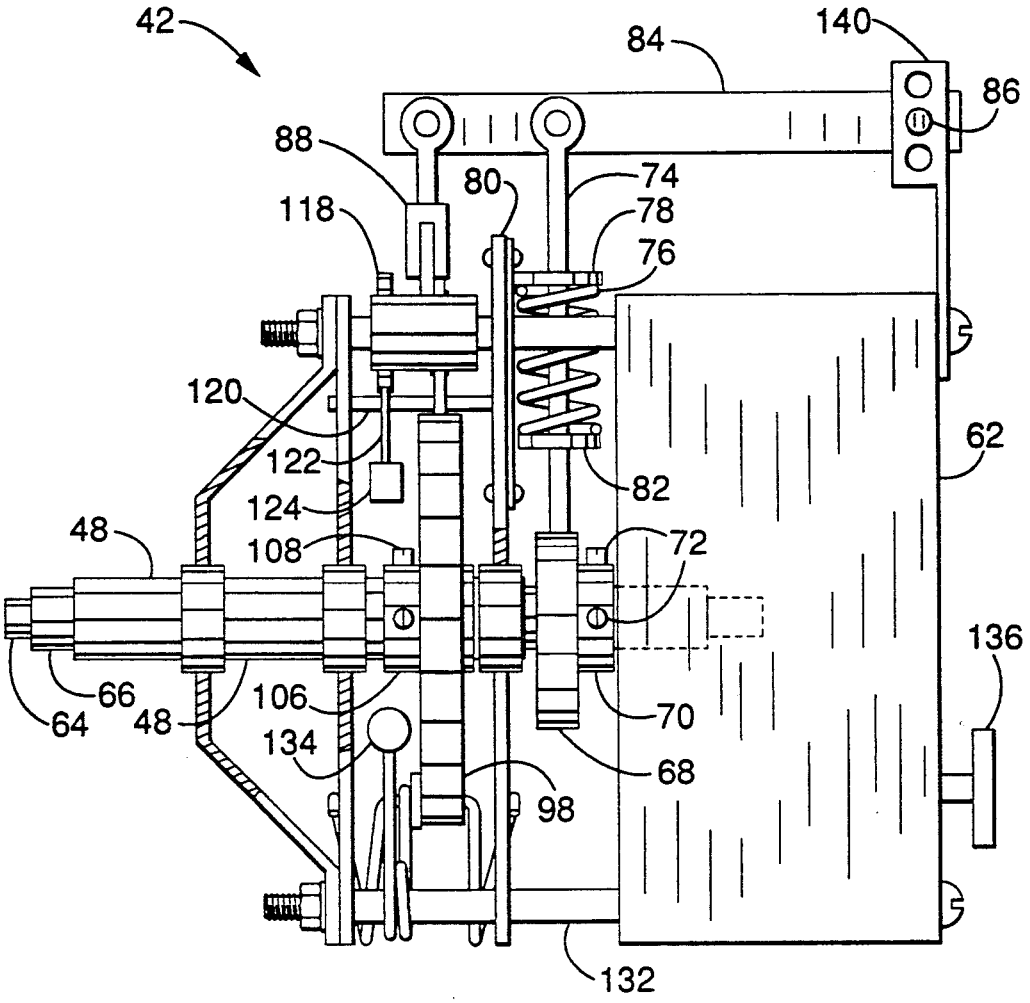
FIG. 4 is a cross-sectional view of the drive mechanism of the clock illustrated in FIG. 2.

Referring now to FIG. 4, drive mechanism 42 includes a synchronous electric motor 62 having a seconds shaft 64 and a concentric minutes shaft 66, both shafts rotating clockwise when the clock is viewed from the front. Seconds shaft 64 revolves at a rate of one revolution per minute, while minutes shaft 66 revolves at a rate of one-sixtieth revolutions per minute, or one-revolution per hour.

Figure 6:
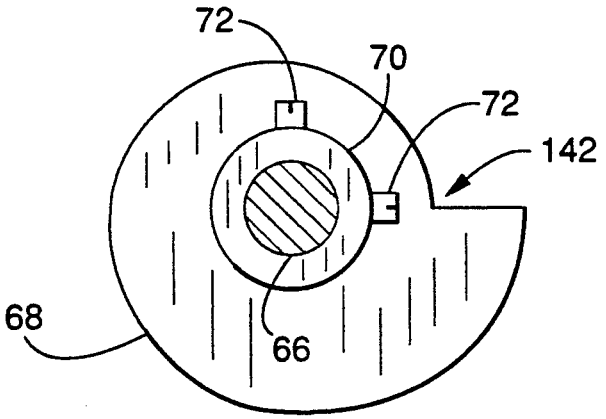
FIG. 6 is a front elevation view of the hour disk drive cam shown in FIG. 4.

Referring to FIG. 4 and FIG. 6 together, eccentric cam 68 slides over and is attached to minutes shaft 66 with collar 70 and a plurality of set screws 72. Therefore, rotation of minutes shaft 66 causes cam 68 to rotate. Cam follower 74 is held against the surface of cam 68 by spring 76. Spring 76 is held in place by spring retainer 78 which is rigidly attached to backing plate 80, and by spring guide plate 82 which is rigidly attached to cam follower 74. The upper end of cam follower 74 is attached to an arm 84 which pivots around pivot pin 86 which is attached to mounting bracket 140. As minutes shaft 66 rotates clockwise, cam 68 rotates eccentrically in a clockwise direction and causes cam follower 74 and arm 84 to be raised. After one complete revolution of cam 68, cam follower 74 drops past cam shelf 142 by the force exerted from spring 76, thus lowering arm 84.

Figure 5:
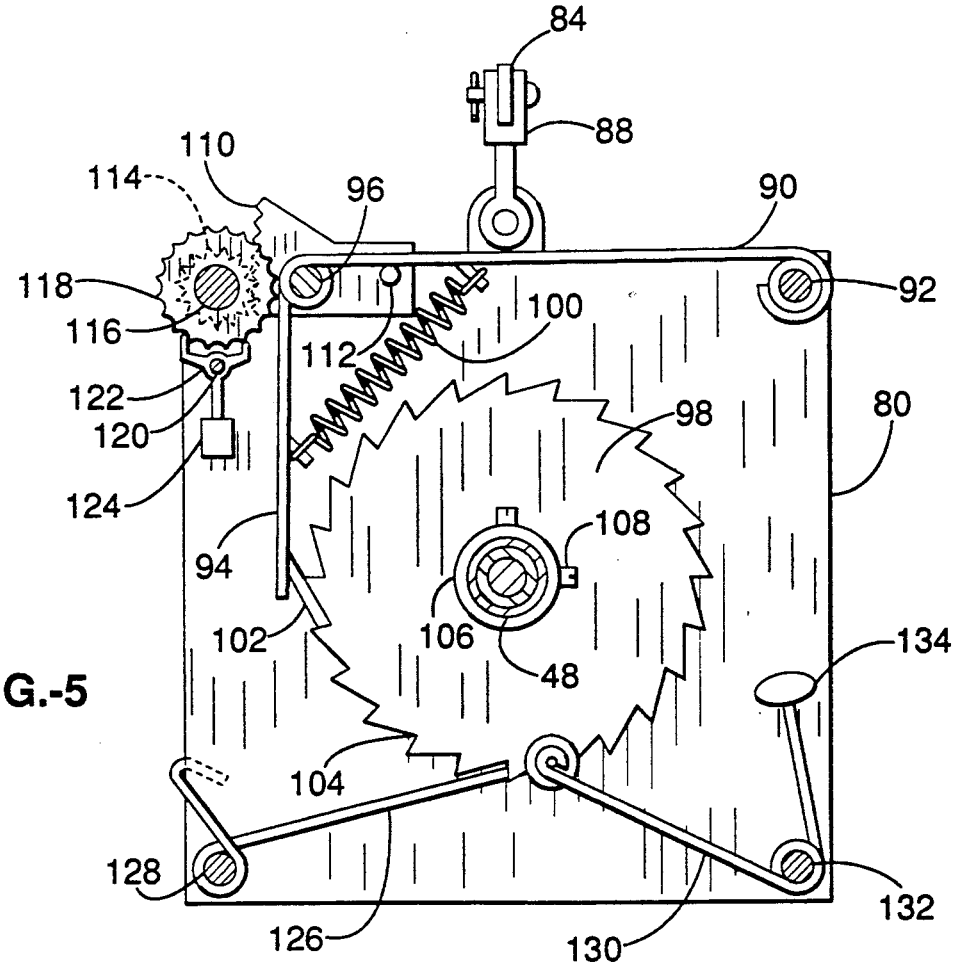
FIG. 5 is front elevation view of the hour disk drive portion of the drive mechanism shown in FIG. 4.

Referring also to FIG. 5, link coupling 88 is attached to arm 84 and to arm 90. Arm 90 pivots around pivot pin 92 which is attached to backing plate 80. Arm 90 is also attached to pawl 94 with hinge 96. Pawl 94 rises and falls with movement of arm 90, and is held against ratchet gear 98 by spring 100 which causes tooth 102 to engage cogs 104. As pawl 94 rises, it engages the next successive cog. As pawl 94 falls, it causes ratchet gear 98 to rotate one step in a counterclockwise direction. By employing twenty-four cogs 104, each step of ratchet gear 98 provides exactly fifteen degrees of rotation. Hours shaft 48, which is concentrically placed over minutes shaft 66, is coupled to ratchet gear 98 with collar 106 and set screws 108. In this fashion, when minutes shaft 66 rotates clockwise one complete revolution, hours shaft 48 steps counterclockwise by fifteen degrees which represents one full time zone of movement.

Because spring 76 must store a sufficient amount of energy when compressed to be able to rotate hours disk 18, if the fall of arm 90 and pawl 94 are not controlled hours disk 18 could spin beyond the desired stopping point. Therefore, the preferred embodiment employs a dampening mechanism which includes a driver gear 110 clamped to arm 90 with follower pin 112 or other means. Driver gear 110 engages driven gear 114 which rotates around idler pin 116. Rigidly attached to driven gear 114 is rocker gear 118 which is larger in diameter than driven gear 114.

When arm 90 falls, driver gear 110 rotates driven gear 114 in a clockwise direction causing rocker gear 118 to also rotate in a clockwise direction. When this occurs, rocker arm 122 begins to oscillate about pivot point 120 at a rate determined by the momentum created by weight 124. The pendulum effect of rocker arm 122 swinging and ratcheting rocker gear 118 slows the descent of arm 90 and pawl 94 by preventing driven gear 114 from freely rotating. As a result, driver gear 110 is prevented from free downward movement and slows the descent of arm 90. Preferably driver gear 110, driven gear 114 and rocker gear 118 have ten teeth per inch (2.54 cm), which in concert with weight 124 cause pawl 94 to descend in twenty equal steps during a period of approximately three seconds.

To further stabilize hours disk 18, one end of detent spring 126 is attached to backing plate 80 and tightly wound around mounting pin 128 which is also attached to backing plate 80. The other end of detent spring 128 is offset and rests firmly against one of the cogs 104 in ratchet gear 98. This prevents ratchet gear 98, and consequently hours disk 18, from "creeping" off the correct time zone setting.

When ratchet gear 98 rotates, detent spring 126 will "snap" into position as cogs 104 move past. The energy released by this snapping action is captured by chime spring 130. One end of chime spring 130 is attached to the offset end of detent spring 126. Chime spring 130 is then loosely wound around pivot pin 132 attached to backing plate 80. Located at the other end of chime spring 130 is a strike hammer 134 which will be flung against a chime or bell (not shown) by the movement of ratchet gear 98. While this represents the preferred embodiment, other forms of audible annunciation could be provided to alert the user to an hour change.

It may also be desirable to alert the user to the approach of an hour change in which instance a second chime could be positioned adjacent to weight 124 which is attached to rocker arm 122. As pawl 94 falls and rocker arm 122 swings from side to side like a pendulum, weight 124 could periodically strike a chime or bell to produce a "tinkling" sound. Alternatively, a buzzer or the like could be employed.

Referring again to FIG. 2 and FIG. 4, drive mechanism 42 is provided with time setting knob 136 coupled to minutes shaft 66 so as to permit the user to rotate minutes shaft 66 until both minutes hand 34 and hours disk 18 reflect the correct time. The apparatus is also provided with a plurality lights 138 attached to frame 38 to produce backlighting for added clarity and differentiation between the daytime hours and the nighttime hours indicated by shaded portion 32 of hours disk 18.

When power is first applied to motor 62, a power on indicator (not shown) illuminates. A switch (not shown) is depressed to extinguish the power on indicator light and to apply power to lights 138. In the event of a power outage, an "outage" monitor and indicator circuit (not shown) is provided to turn lights 138 off and to illuminate the power on indicator. This feature alerts the user to the occurrence of a power outage so that he or she can reset the time. Additionally, a motor on-off switch (not shown) is provided to permit the user to synchronize seconds hand 36 with a time standard.

Accordingly, it will be seen that this invention provides a universal world clock which depicts accurate universal time throughout the world as well as indicating day/night status in each location. While the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A universal world clock apparatus, comprising:

(a) a timing mechanism, said timing mechanism including a first rotatable shaft and a second rotatable shaft, said first rotatable shaft making one complete revolution every twenty-four hours, said second rotatable shaft making one complete revolution every sixty minutes;

(b) a frame, said frame supporting said timing mechanism;

(c) a substantially translucent first disk, said first disk having a projection of the world covering substantially the entire front surface of said first disk, said projection of the world being centered at the south pole with the land masses of the world being geographically presented with accurate longitude and latitude, said first disk including a plurality of time zone indicators projecting radially from the central portion of said first disk in increments of fifteen degrees, said first disk rotatably coupled to said frame;

(d) a substantially transparent second disk, said second disk positioned over said front surface of said first disk, said second disk including a plurality of time zone pointers, said time zone pointers positioned around the periphery of said second disk in increments of fifteen degrees, said time zone pointers positioned over said time zone indicators, said second disk fixedly attached to said frame;

(e) a substantially transparent third disk, said third disk positioned over said second disk, said third disk including hour indicators positioned around the periphery of said third disk in fifteen degree increments, said hour indicators depicting hours of day and night, said third disk being shaded over approximately one-half of its surface to indicate night, said third disk coupled to said first rotatable shaft;

(f) said timing mechanism rotating said third disk in steps of fifteen degrees each, each said step corresponding to one time zone, said third disk rotating one complete revolution in twenty-four hours, each said step positioning said hour indicators over said time zone indicators; and (g) a minutes indicator, said minutes indicator positioned in the central portion of said disks, said minutes indicator including a minutes pointer coupled to said second rotatable shaft, said minutes pointer rotating one complete revolution in sixty minutes.

2. The clock as recited in claim 1, further comprising backlight means for illuminating said projection of the world, said backlight means attached to said frame behind said first disk.

3. The clock as recited in claim 1, further comprising:

(a) a third rotatable shaft, said third rotatable shaft coupled to said timing mechanism; and (b) a seconds indicator, said seconds indicator including a seconds pointer, said seconds pointer coupled to said third rotatable shaft, said seconds pointer rotating one complete revolution in sixty seconds.

4. The clock as recited in claim 1, wherein said time zone pointers include a standard time pointer and a fast time pointer, said standard time pointer positioned over the time zone indicator corresponding to the user's universal standard time, said fast time pointer indicating one hour later than said user's universal standard time.

5. The clock as recited in claim 1, further comprising audible annunciating means for indicating each said step of rotation of said third disk.

6. The clock as recited in claim 1, wherein the user's geographical location on said projection of the world is vertically positioned to preserve an overhead northerly user orientation in reference to said projection of the world.

7. The clock as recited in claim 1, further comprising damper means for slowing the speed of rotation of said third disk.

8. A clock for determining time at any geographic location in the world, comprising:

(a) a housing, said housing including a frame;

(b) a substantially translucent first disk, said first disk having a projection of the world covering substantially the entire front surface of said first disk, said projection of the world being centered at the south pole with the land masses of the world being geographically presented with accurate longitude and latitude, said first disk including a plurality of time zone indicators projecting radially from the central portion of said first disk in increments of fifteen degrees, said first disk rotatably coupled to said frame;

(c) a substantially transparent second disk, said second disk having substantially the same diameter as said first disk, said second disk positioned over said front surface of said first disk, said second disk including a plurality of time zone pointers, said time zone pointers positioned around the periphery of said second disk in increments of fifteen degrees, said time zone pointers positioned over said time zone indicators, said second disk fixedly attached to said frame;

(d) a timing mechanism, said timing mechanism including a first rotatable shaft and a second rotatable shaft, said first rotatable shaft making one complete counterclockwise revolution every twenty-four hours, said second rotatable shaft making one complete clockwise revolution every sixty minutes, said frame supporting said timing mechanism;

(e) a substantially transparent third disk, said third disk having substantially the same diameter as said first disk, said third disk positioned over said second disk, said third disk including hour indicators positioned around the periphery of said third disk in fifteen degree increments, said hour indicators depicting hours of day and night, said third disk being shaded over approximately one-half of its surface to indicate night, said third disk coupled to said first rotatable shaft;

(f) said timing mechanism rotating said third disk in steps of fifteen degrees each, each said step corresponding to one time zone, said third disk rotating one complete counterclockwise revolution in twenty-four hours, each said step positioning said hour indicators over said time zone indicators; and (g) a minutes indicator, said minutes indicator positioned in the central portion of said disks, said minutes indicator including a minutes pointer coupled to said second rotatable shaft, said minutes pointer rotating one complete clockwise revolution in sixty minutes.

9. The clock as recited in claim 8, further comprising backlight means for illuminating said projection of the world, said backlight means attached to said frame behind said first disk.

10. The clock as recited in claim 9, further comprising:

(a) a third rotatable shaft, said third rotatable shaft coupled to said timing mechanism; and (b) a seconds indicator, said seconds indicator including a seconds pointer, said seconds pointer coupled to said third rotatable shaft, said seconds pointer rotating one complete revolution in sixty seconds.

11. The clock as recited in claim 10, wherein said time zone pointers include a standard time pointer and a fast time pointer, said standard time pointer positioned over the time zone indicator corresponding to the user's universal standard time, said fast time pointer indicating one hour later than said user's universal standard time.

12. The clock as recited in claim 11, further comprising audible annunciating means for indicating each said step of rotation of said third disk.

13. The clock as recited in claim 12, wherein the user's geographical location on said projection of the world is vertically positioned to preserve an overhead northerly user orientation in reference to said projection of the world.

14. The clock as recited in claim 13, further comprising damper means for slowing the speed of rotation of said third disk.

15. A world clock and map apparatus, comprising:

(a) a timing mechanism, said timing mechanism including a first rotatable shaft and a second rotatable shaft, said first rotatable shaft making one complete revolution every twenty-four hours, said second rotatable shaft making one complete revolution every sixty minutes;

(b) a frame, said frame supporting said timing mechanism;

(c) a substantially translucent first disk, said first disk having a projection of the world covering substantially the entire front surface of said first disk, said projection of the world being centered at the south pole with the land masses of the world being geographically presented with accurate longitude and latitude, said first disk including a plurality of time zone indicators projecting radially from the central portion of said first disk in increments of fifteen degrees, said first disk rotatably coupled to said frame;

(d) a substantially transparent second disk, said second disk having substantially the same diameter as said first disk, said second disk positioned over said front surface of said first disk, said second disk including a plurality of time zone pointers, said time zone pointers positioned around the periphery of said second disk in increments of fifteen degrees, said time zone pointers positioned over said time zone indicators, said second disk fixedly attached to said frame;

(e) a substantially transparent third disk, said third disk having substantially the same diameter as said first disk, said third disk positioned over said second disk, said third disk including hour indicators positioned around the periphery of said third disk in fifteen degree increments, said hour indicators depicting hours of day and night, said third disk being shaded over approximately one-half of its surface to indicate night, said third disk coupled to said first rotatable shaft;

(f) said timing mechanism rotating said third disk in steps of fifteen degrees each, each said step corresponding to one time zone, said third disk rotating one complete revolution in twenty-four hours, each said step positioning said hour indicators over said time zone indicators;

(g) a minutes indicator, said minutes indicator positioned in the central portion of said disks, said minutes indicator including a minutes pointer coupled to said second rotatable shaft, said minutes pointer rotating one complete revolution in sixty minutes;

(h) backlight means for illuminating said projection of the world, said backlight means attached to said frame behind said first disk;

(i) a third rotatable shaft, said third rotatable shaft coupled to said timing mechanism; and (j) a seconds indicator, said seconds indicator including a seconds pointer, said seconds pointer coupled to said third rotatable shaft, said seconds pointer rotating one complete revolution in sixty seconds.

16. The clock as recited in claim 15, further comprising audible annunciating means for indicating each said step of rotation of said third disk.

17. The clock as recited in claim 15, wherein said time zone pointers include a standard time pointer and a fast time pointer, said standard time pointer positioned over the time zone indicator corresponding to the user's universal standard time, said fast time pointer indicating one hour later than said user's universal standard time.

18. The clock as recited in claim 15, wherein the user's geographical location on said projection of the world is vertically positioned to preserve an overhead northerly user orientation in reference to said projection of the world.

19. The clock as recited in claim 16, further comprising audible annunciating means for indicating the approach of each said change in step of rotation of said third disk.

20. The clock as recited in claim 15, further comprising damper means for slowing the speed of rotation of said third disk.

* * * * *